United States Patent [19]

Shustov

[11] Patent Number: 4,965,895

[45] Date of Patent: Oct. 30, 1990

[54] EARTHQUAKE SHELTER WITH BED SUPPORT AND CANOPY

[76] Inventor: Valentin N. Shustov, 536¾ N.Genesee Ave., Los Angeles, Calif. 90036

[21] Appl. No.: 363,592

[22] Filed: May 26, 1989

Related U.S. Application Data

[63] Continuation-in-part of Ser. No. 214,935, Aug. 29, 1988, abandoned.

[51] Int. Cl.[5] ..... A47C 29/00

[52] U.S. Cl. ..... 5/414; 5/207; 5/2.1; 248/346.1

[58] Field of Search ..... 5/414, 207, 208, 508, 5/2 R; 52/167; 248/346.1

[56] References Cited

U.S. PATENT DOCUMENTS

| | | | |
|---|---|---|---|
| 2,705,928 | 4/1955 | Pont | 52/167 R |
| 4,069,527 | 1/1978 | Harris | 5/414 |
| 4,718,132 | 1/1988 | Wirland | 5/207 |
| 4,726,161 | 2/1988 | Yaghoubian | 52/167 R |
| 4,779,294 | 10/1988 | Miller | 5/414 |

OTHER PUBLICATIONS

"Pro-Tech TM Canopy", a pamphlet of Pro-Tech Co. 7159 Navado Rd., San Diego, Calif. 92119-9930.

*Primary Examiner*—Alexander Grosz

[57] ABSTRACT

A manufacture for sheltering people in a case of earthquake emergency using an existing bed. The shelter is designed to protect people on the bed from collapsing structural and nonstructural elements of the building. The shelter has a horizontal frame of shelves for placing the bed on, confiners for fixing the bed, a cover on supports, and a base isolating system of ball-bearing footholds on pedestal plates with concave upper surfaces of proper curvature. Due to properly selected materials, shapes and cross-sections of its elements the shelter provides its own strength under the falling debris, and as a result secures people on the bed, while the base isolating system eliminates horizontal shaking of the shelter and thus prevents people on the bed from being thrown out of protective cover.

1 Claim, 1 Drawing Sheet

EARTHQUAKE SHELTER WITH BED SUPPORT AND CANOPY

This application is a continuation-in-part application of application Ser. No. 214,935 filed Aug. 29, 1988, now abandoned.

BACKGROUND OF THE INVENTION

1. Field of the Invention

The present invention relates to shelters. More particularly, the invention relates to an earthquake shelter.

2. Description of the Prior Art

There is no evidence of existence of any place or something in the dwelling house or a hospital that could be used as a reliable, convenient and ever ready shelter for earthquake hazard protection.

Bombshelter and shelter from harricanes do not fit: they are located in vaults of buildings and thereby are usually far from residential areas, or/and they demand considerable construction expenses. Besides, it is very difficult or even impossible to persuade people to seek safety underground while the ground itself seems to crack.

The sudden shock of a strong earthquake does not leave enough time for tenants even in good health to escape the menace of wrecking structures, provided a shelter, especially at night, is in the close vicinity. For sick or handicapped people the transportation to any distant shelter within a few seconds period is especially impractical.

U.S. Pat. No. 4,069,527, entitled "Protective bed canopy", describes a bed including a canopy having a framework composed of a plurality of longitudinal and transverse trusses, a layer of fabric, all supported upon reinforced posts projecting upward from the corners of the bed frame. This canopy bed, however, is confined to a very specific type of protective cover, and what is the most important, the described system is an entity with the bed frame and therefore it is supposed to replace an existing conventional bed instead of keeping to use it. Besides, the said canopy bed does not prevent people on it from being thrown off under severe horizontal shaking and thus being exposed to falling debris.

U.S. Pat. No. 4,779,294, entitled "Protective structure", describes a shed on four legs that should be positioned above the protected bed. This structure can be used with any existing bed but it is very unstable and can be easily overturned under a strong horizontal vibration.

SUMMARY AND DESCRIPTION OF THE INVENTION

To mitigate hazards to occupants during an earthquake and at the same time to utilize the existing bed the shelter is offered (FIG. 1) which consists of a protective cover (1) on supports (2) with shelves (3) and confiners (4). The shelter is provided with ball-bearing embedments (5) which rest on pedestal plates with concave upper surfaces of spherical shape (6). An existing conventional bed (7) is to be mounted under the cover (1) on the shelves (3) as shown on FIG. 2 and fixed with confiners (4). The bed except for its basic purpose serves for placing tenants of the house or patients of the hospital in the most stable, horizontal position and for providing stability against overturning of the shelter. The shelves (3) connected in a flat frame not only create a foothold for the bed (7) but add to rigidity of the system. The ball-bearing embedments (5) on the pedestal plates (6) of a proper diameter d (d should be less than double maximum amplitude of any possible horizontal vibration of the floor during a strong earthquake) and with the proper radius of vertical curvature R (R should be approximately more than 1 m in order to guarantee a sufficient clearance between the natural vibration period of the "bed-shelter" system and that of the building) considerably isolate the protected bed against earthquake induced horizontal shaking of the floor (FIG. 3).

The supports (2) and protective cover (1) are made so that they could not destroy essential functional, aesthetic and architectural features of the bed as a piece of furniture, and the shelter over the bed together with the bed itself may look like a well known canopy-bed since they have the same structural elements. But the shelter over existing bed posesses a totally new quality: with object to withstand considerable vertical and horizontal loads and by means of properly selected materials, shapes and cross-sections the shelter is provided with such an extent of bearing capacity which is sufficient to secure people on the bed against possible fall of debris and structural members from above. Besides, the ball-bearing supports (5) together with the pedestal plates (6) practically isolate the system "bed-shelter" from being horizontally shaken and thus securing people on the bed against being knocked out under the falling debris. An ordinary canopy cannot provide such a security because it is designed basically as a decorative piece of furniture. The protective bed-canopy according to U.S. Pat. No. 4,069,527 can neither utilize existing beds nor isolate them from horizontal shaking. In contrast to protective structure per U.S. Pat. No. 4,779,294 the suggested shelter not only is treating the bed as an objective for protection but using it as an active part of protective system which provides the said system with stability against horizontal vibration.

BRIEF DESCRIPTION OF THE DRAWINGS

In the description of the invention herein presented, reference is made to the accompanying drawings, in which.

Figure 1:
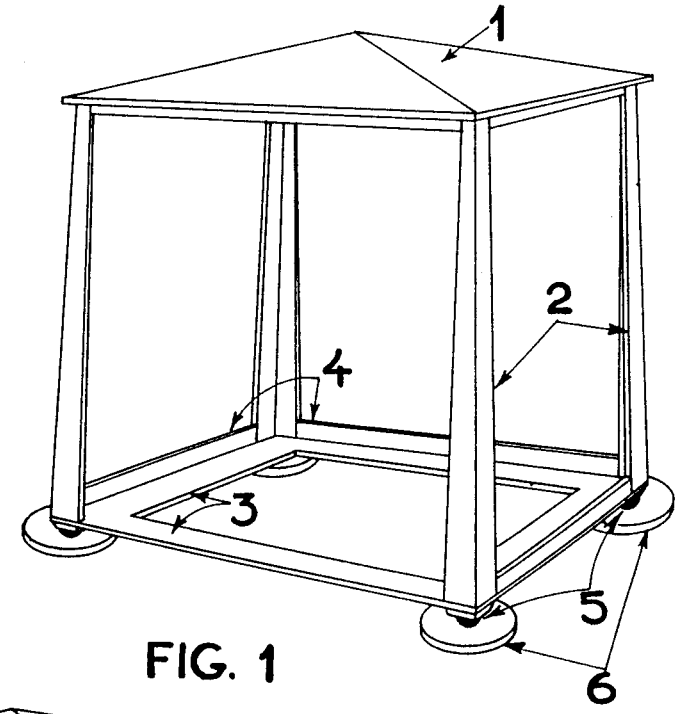
FIG. 1 is a schematic perspective of an earthquake shelter.
Figure 2:
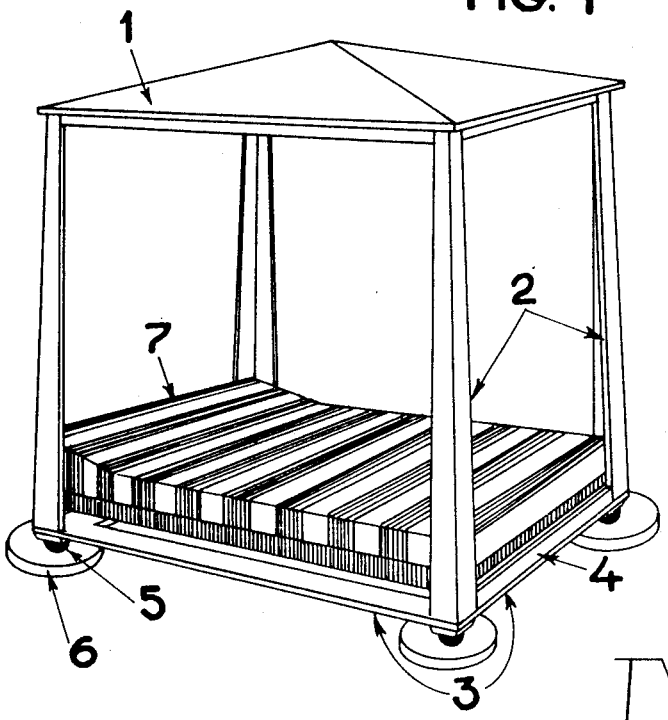
FIG. 2 is a schematic perspective of the said shelter with a protected bed inside it.
Figure 3:
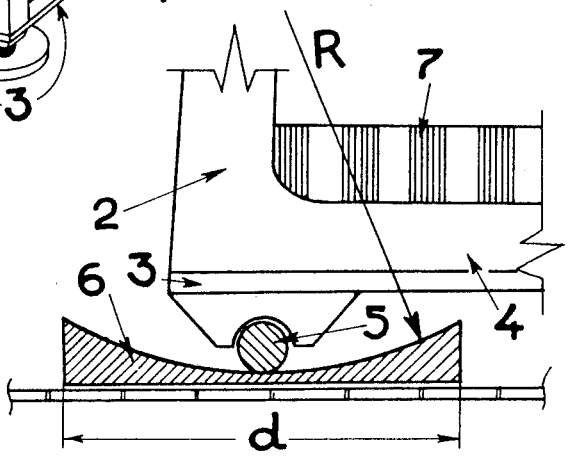
FIG. 3 is a schematic perspective of the shelter base isolating device.

What is claimed is:

1. A system adapted to protect an occupant of a bed during an earthquake, comprising a generally rectangular frame system defined by a generally rectangular protective cover supported by generally vertical supports at its corners, each said support including a ball bearing at its lower end, each said ball bearing being supported on a pedestal plate having a concave upper surface, the ball bearings supported on the pedestal plates permitting movement of the frame system during an earthquake, the frame system further including generally horizontal shelves located between said supports, said horizontal shelves being circumscribed by generally vertical confiners, said shelves being of a sufficient size to support a bed beneath said protective cover, the frame system being designed and being made from materials adapted to protect an occupant of the bed supported on the shelves of the frame system from structures collapsing on the frame system during an earthquake.

* * * * *